US005671330A

United States Patent [19]

Sakamoto et al.

[11] Patent Number: 5,671,330

[45] Date of Patent: Sep. 23, 1997

[54] SPEECH SYNTHESIS USING GLOTTAL CLOSURE INSTANTS DETERMINED FROM ADAPTIVELY-THRESHOLDED WAVELET TRANSFORMS

[75] Inventors: Masaharu Sakamoto, Yokohama; Mei Kobayashi; Takashi Saito, both of Tokyo; Masafumi Nishimura, Yokohama, all of Japan

[73] Assignee: International Business Machines Corporation, Armonk, N.Y.

[21] Appl. No.: 500,793

[22] Filed: Jul. 11, 1995

[30] Foreign Application Priority Data

Sep. 21, 1994 [JP] Japan ..... 6-226667

[51] Int. Cl.[6] ..... G10L 5/04

[52] U.S. Cl. ..... 395/2.77; 395/2.16; 395/2.73; 395/2.76

[58] Field of Search ..... 395/2.16, 2.2, 395/2.73, 2.76, 2.77

[56] References Cited

U.S. PATENT DOCUMENTS

| | | | |
|---|---|---|---|
| 5,054,085 | 10/1991 | Meisel et al. | 395/2.16 |
| 5,175,769 | 12/1992 | Hejna, Jr. et al. | 395/2.2 |
| 5,479,564 | 12/1995 | Vogten et al. | 395/2.76 |
| 5,524,172 | 6/1996 | Hamon | 395/2.77 |
| 5,581,652 | 12/1996 | Abe et al. | 395/2.31 |

FOREIGN PATENT DOCUMENTS

| | | | |
|---|---|---|---|
| WO95/26024 | 9/1995 | WIPO | G10L 5/04 |

OTHER PUBLICATIONS

Stephane Mallat and Sifen Zhong, "Characterization of Signals from Multiscale Edges," IEEE Transactions on Pattern Analysis and Machine Intelligence, vol. 14, No. 7, pp. 710–732. Jul. 1992.

Gianpolo Evangelista, "Pitch–Synchronous Wavelet Representation of Speech and Music Signals," IEEE Transactions on Signal Processing, vol. 41, No. 12, pp. 3313–3330. Dec. 1993.

Lunji Qiu, Soo–Ngee Koh, and Hayun Yang, "Pitch Determination of Noisy Speech Using Wavelet Transform in Time and Frequency Domains," Proceedings of IEEE TENCON '93, pp. 337–340. Oct. 1993.

Glenn A. Shelby, Christopher M. Cooper, and Reza R. Adhami, "A Wavelet–Base Speech Pitch Detector for Tone Languages," Proceedings of the IEEE–SP International Symposium on Time–Frequency and Time–Scale Analysis, pp. 596–599. Oct. 1994.

William J. Pielemeier, Gregory H. Wakefield, and Mary H. Simoni, "Time–Frequency Analysis of Musical Signals," Proc. IEEE, vol. 84, No. 9, pp. 1216–1230. Sep. 1996.

*Primary Examiner*—Allen R. MacDonald
*Assistant Examiner*—Tálivadis Ivars Šmits
*Attorney, Agent, or Firm*—Robert P. Tassinari, Jr.

[57] ABSTRACT

A speech synthesis system making use of a pitch-synchronous waveform overlap method to realize stable speech synthesis processing in which pitch shaking is negligible. The present invention is characterized in that glottal closure instants are used as reference points (pitch marks) for overlapping. Since the glottal closure instants can be extracted stably and accurately by using dyadic Wavelet conversion, speech in which pitch shaking is negligible and rumbling sounds are minimized can be synthesized stably. In addition, more flexible waveform separation becomes possible by setting the reference point for overlapping and the reference point for waveform separation to different positions. The extraction of glottal closure instants is performed by searching the local peaks of the dyadic Wavelet conversion, but preferably a threshold value for searching for the local peaks of the dyadic Wavelet conversion is adaptively controlled each time dyadic Wavelet conversion is obtained.

12 Claims, 4 Drawing Sheets

SPEECH SYNTHESIS USING GLOTTAL CLOSURE INSTANTS DETERMINED FROM ADAPTIVELY-THRESHOLDED WAVELET TRANSFORMS

FIELD OF THE INVENTION

The present invention relates to speech synthesis techniques and, more particularly, to a speech synthesis method and system using a pitch-synchronous waveform overlap method.

BACKGROUND OF THE INVENTION

The so-called pitch-synchronous waveform overlap method is known in the field of speech synthesis (e.g., F. Charpentier, M. Stella, "Diphone synthesis using an overlapped technique for speech waveform concatenation," Proc. Int. Conf. ASSP, 2015–2018, Tokyo, 1986). This is a method which pitch-marks waveforms at the local peaks thereof, separates the waveforms at the pitch-marked positions by using a window function, and overlaps the separated waveforms along a synthesis pitch by shifting them when speech is synthesized.

It is necessary in speech synthesis by a pitch-synchronous waveform overlap method to obtain a pitch mark for each pitch. Thus, the following have been proposed so far as a pitch mark position:

1. Point in time immediately before the short time power of speech synthesis changes drastically
2. Peak of the short time power in speech synthesis
3. Peak of the speech waveform The method using these pitch-marked positions is subject to the influence of a change in the vicinity of peak of speech synthesis, and the pitch mark shakes for each pitch. This causes the shaking of the pitch when speech is synthesized, and therefore the synthesized speech produces a rumbling sound. Therefore, a more stable reference point has been desired for overlapping.

Since the above-described conventional pitch-marked position is unstable and unsuitable as a reference point for overlapping, but the pitch mark serves both as the reference point for overlapping 10 and the center of a waveform separation window, such a pitch-marked position has been considered unavoidable despite spectral distortion by waveform separation.

Incidentally, in S. Mallat, S. Zhong, "Characterization of Signals from Multiscale Edges," IEEE Trans. Pattern Analysis and Machine Intelligence, Vol. 14, No. 7, pp. 710–732, Jul. 1992," it is shown that, if a Wavelet function is selected as a first-order differential of a smoothing function, the local peak of dyadic Wavelet conversion by the wavelet function will be consistent with that point in time where the signal changes abruptly.

Also, in S. Kadambe, G. F. Boudreaux-Bartels, "Application of the Wavelet Transform for Pitch Detection of Speech Signals," IEEE Trans. Information Theory, Vol. 38, No. 2, pp. 917–924, 1992," there has been proposed a method which makes use of the fact that a speech waveform changes at its glottal closure instant abruptly, detects the glottal closure instant by searching for a local peak in the speech waveform of the Wavelet conversion of the speech waveform, and estimates the pitch period.

It is to be noted that, in methods such as Kadambe's method, frame processing has been performed and a threshold value for searching for a local peak is held constant within the frame. Therefore, when the speech waveform of, for example, a power dip within the frame changes abruptly, drawbacks occur in that, when the falling and insertion of the glottal closure instant take place, the shift width of the frame is limited to half of the wavelet length because of the end effect of convolution, and there is therefore a need to calculate convolution repeatedly, so a processing delay of about one frame length (about 30 ms) occurs. If the method remains unchanged, it will be inconvenient from the standpoint of extraction accuracy and the amount of calculation involved to use it as a pitch-marking method. Because of the processing delay, it is also unsuitable to speech quality conversion being done in real time.

Further, Japanese PUPA 5-265479 by Chang-Xue and Leonardus F. Willems, "Voice Signal Processor" Oct. 15, 1993, assigned to Philips Electronic discloses that, in a speech signal processing apparatus having a detection means for selectively determining the continuous time instants of a glottal closure by determining the specific peak of an intensity depending upon the time of a speech signal, the apparatus comprises a filtering means for forming a filter signal from a speech signal through the de-emphasis of a spectral portion less than the predetermined frequency, and an averaging means for generating the flow of time of an averaged value representing an intensity dependent on the time of the speech signal, and the filtered signal is supplied to the averaging means by the filtering means.

SUMMARY OF THE INVENTION

It is an object of the present invention to realize, in a speech synthesis method making use of a pitch-synchronous waveform overlap method, stable speech synthesis processing in which the pitch shaking is negligible.

In accordance with the present invention there is provided a pitch-synchronous waveform overlap method in which glottal closure instants are used as pitch marks (reference points).

Since the glottal closure instants can be extracted stably and accurately by using a dyadic Wavelet conversion, speech in which pitch shaking is negligible and rumbling sounds are minimized can be synthesized with stability.

In addition, a more flexible waveform separation becomes possible compared to the conventional technique by setting, in accordance with the present invention, the reference point for overlapping and the waveform separation center at the time of synthesis to different positions.

The extraction of glottal closure instants is performed by searching for the local peaks of the dyadic Wavelet conversion, but, preferably, a threshold value for searching for the local peaks of dyadic Wavelet conversion is adaptively controlled each time dyadic Wavelet conversion is obtained. The following advantages are therefore obtained:

1. The glottal closure instants can be extracted stably and accurately.
2. There is no necessity to repeat convolution calculation as must be done in the case of frame processing.
3. Processing delays can be prevented, although if some processing delay is allowed, accuracy will be further improved.

Because of these advantages, this method can also be used in the automatic generation of a waveform element dictionary and to a real-time automatic pitch marking method for input speech waveforms for speech quality conversion by pitch-synchronous waveform overlap and speech signal compression.

DETAILED DESCRIPTION OF THE PREFFERED EMBODIMENT

The present invention will hereinafter be described with reference to the figures.

A. Hardware Constitution

Figure 1:
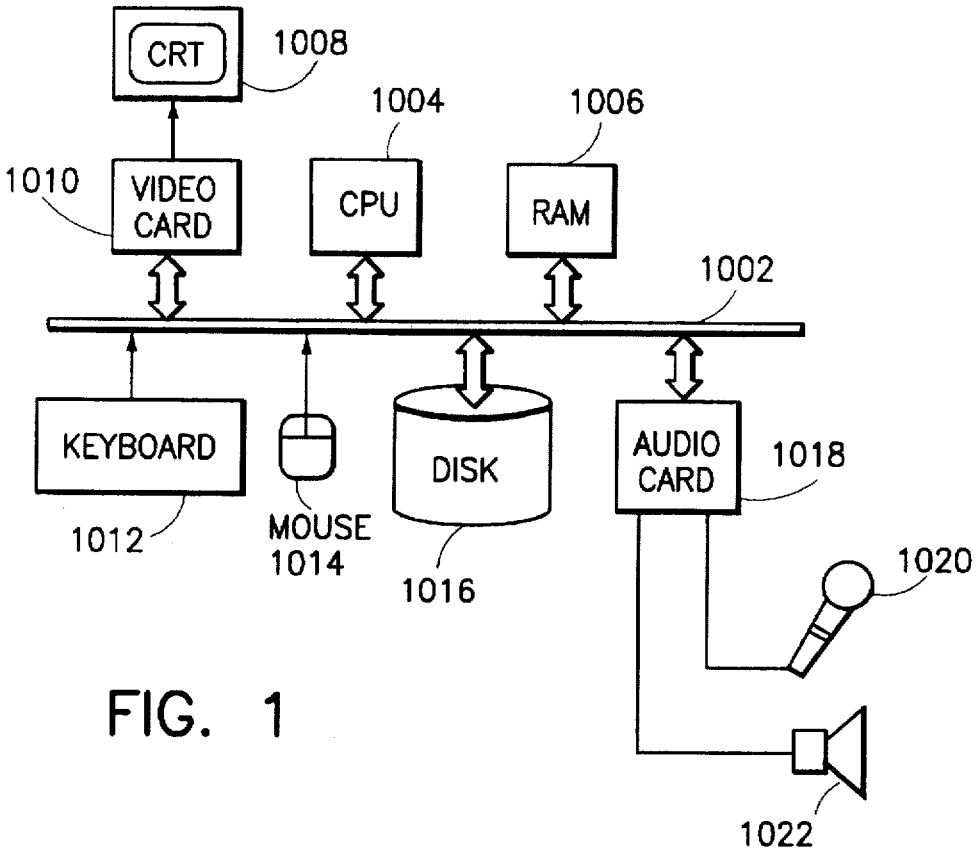
FIG. 1 is a block diagram showing the configuration of hardware through which the present invention is realized.

Reference is made to FIG. 1, which shows the hardware configuration in which the present invention is carried out. This configuration includes a CPU 1004 for performing calculation and input-output control, a RAM 1006 for providing buffer regions for program loading and calculation, a CRT unit 1008 for displaying characters and image information on the screen thereof, a video card 1010 for controlling the CRT unit 1008, a keyboard 1012 through which commands or characters are input by an operator, a mouse 1014 by which an arbitrary point on the screen is pointed to and information on the position is sent to the system, a magnetic disk unit 1016 for recording programs and data permanently so that they can be read and written, a microphone 1020 for recording speech, a speaker 1022 for outputting synthesized speech as a sound, and a common bus 1002.

Specifically, the operating system to be loaded when the system is started, a processing program according to the present invention to be described later, speech files taken in from the microphone 1020 and A/D-converted, a dictionary of synthesis units of sound elements obtained from the result of analysis of the speech files, and a word dictionary for text analysis are stored on the magnetic disk unit 1016.

Although an operating system suitable for the processing of the present invention is OS/2 (IBM trademark), an arbitrary operating system providing an interface with respect to an audio card, such as MS-DOS (Microsoft trademark), PC-DOS (IBM trademark), Windows (Microsoft trademark), and AIX (IBM trademark) can also be used.

The audio card 1018 may be such that a signal input as speech through the microphone 1020 can be converted to a digital form such as PCM and also data in such a digital form can be output as speech from the speaker 1022. An audio card provided with a digital signal processor (DSP) is highly effective and suitable as the audio card 1018. However, since a quantity of data processing is relatively small according to the present invention, a sufficiently high processing speed is obtained even if the DPS is not used and the A/D-converted signal is processed by software.

B. Logical Constitution

The logical constitution of the present invention will next be described with reference to FIGS. 2 and 3.

B1. Speech Input Section

Figure 2:
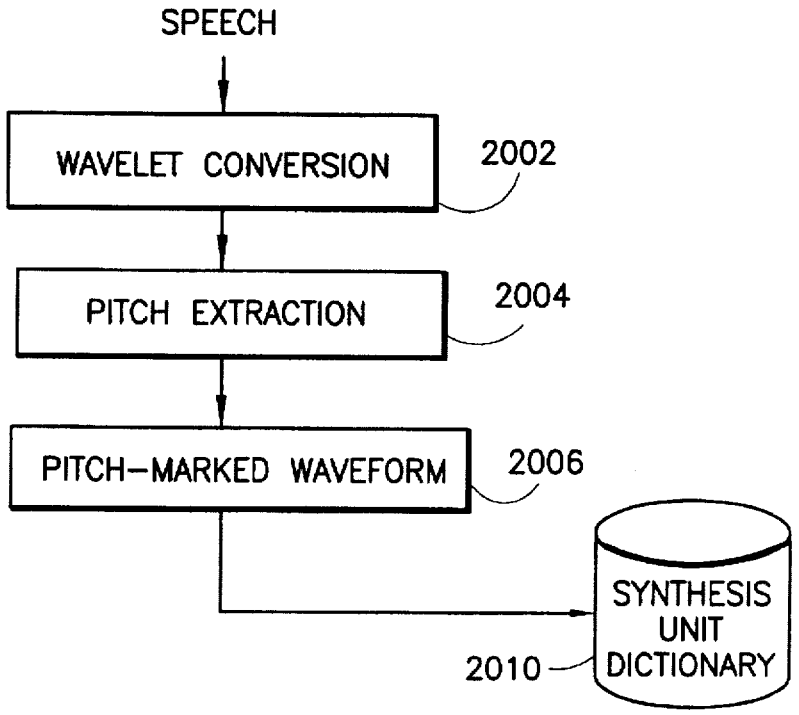
FIG. 2 is a block diagram showing processing modules for Wavelet conversion and pitch mark application.

Referring to FIG. 2, the speech input section typically comprises a dyadic Wavelet conversion section 2002 and a pitch extraction section 2004. These modules are normally stored in the disk unit 1016 and loaded into RAM 10006, which is where processing is performed, in response to an operation of the operator.

The speech input from the microphone 1020 is first converted in the dyadic Wavelet conversion section 2002 by dyadic Wavelet conversion. A general description of dyadic Wavelet conversion is shown, for example, in above-described Kadambe's thesis. However, what should be understood is that a preferred embodiment of the present invention uses a techniques for changing a threshold value adaptively, unlike Kadambe's method. This processing will hereinafter be described in detail.

Next, the dyadic-Wavelet-converted signal is pitch-marked in the pitch extraction section 2004 to make use of a pitch-synchronous overlap method later. In pitch-marking, the present invention is characterized in that glottal closure instants obtained as the above-described dyadic Wavelet conversion are selected as the reference points of pitch marks. This processing will also be described in detail later.

The data 2006 of the pitch-marked waveform obtained in this way is separated as a synthesis unit by a predetermined window function and then stored in a synthesis unit dictionary 2010, which is actually a file stored in the magnetic disk unit 1016, in order to use it in subsequent speech synthesis.

B2. Speech Synthesis Section

Figure 3:
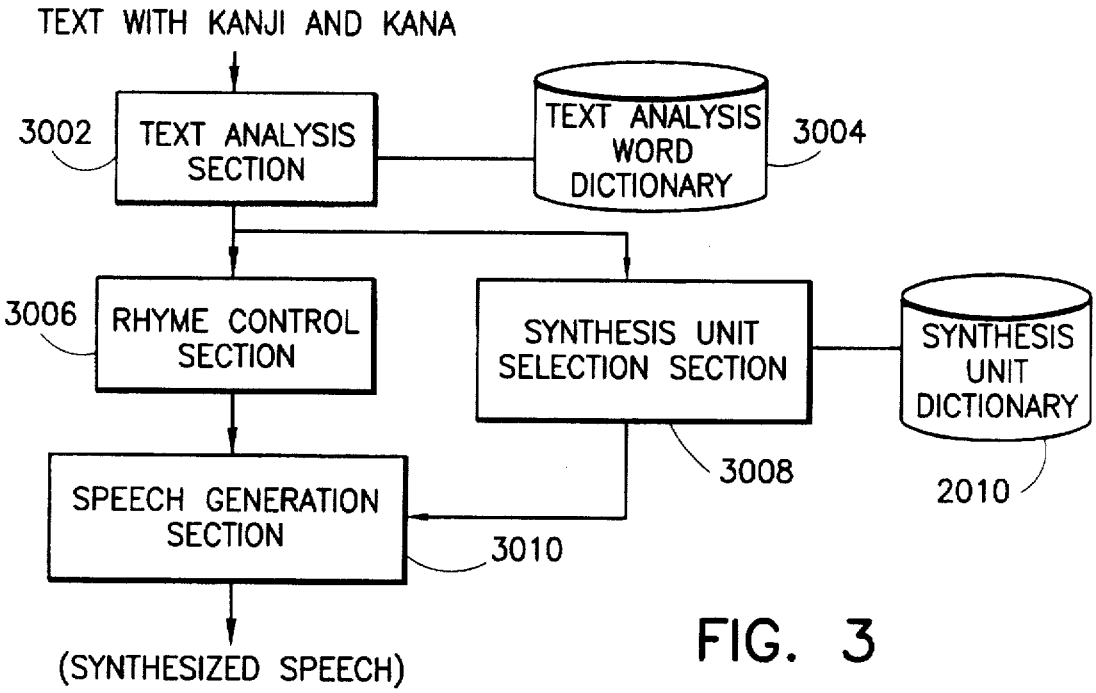
FIG. 3 is a block diagram showing processing modules for performing speech synthesis processing.
Figure 6:
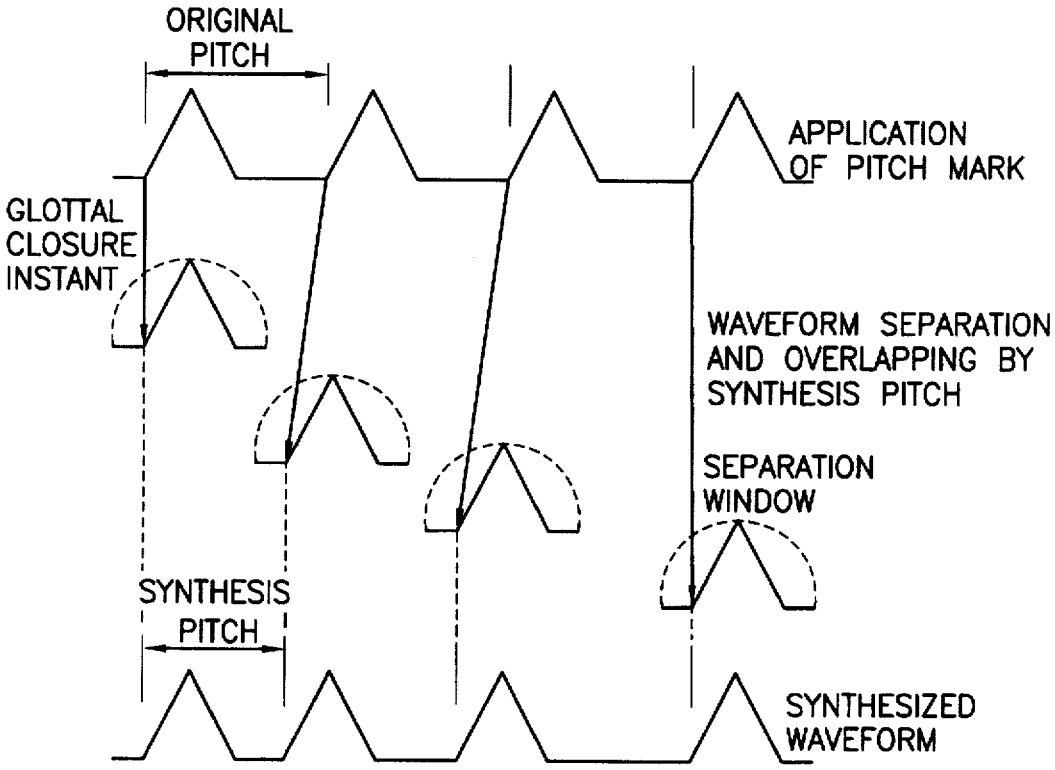
FIG. 6 is a diagram showing the process of pitch-marking glottal closure instants and waveforms which are overlapped at the pitch-marked glottal closure instants to synthesize speech.

Referring to FIG. 3, the speech synthesis section comprises a text analysis section 3002 for inputting a text file including both kana (Japanese alphabet) and kanji (Japanese alphabet) by making reference to a text analysis word dictionary 3004, a rhyme control section 3006 for controlling a rhyme based on the context of the analysis result of the text analysis section 3002, a synthesis unit selection section 3008 for retrieving the synthesis unit dictionary generated in advance by the above-described speech input section and selecting speech synthesis units, and a speech synthesis section 3010 for outputting a row of speech synthesis units selected by the synthesis unit selection section 3008 in the rhyme controlled by the rhyme control section 3006 from the speaker 1022 as synthesized speech.

Particularly, in the present invention, the speech synthesis section 3010 performs speech synthesis according to the speech synthesis units pitch-marked by the pitch extraction section 2004 in FIG. 2 by making use of the pitch-synchronous waveform overlap method.

It is to be noted that, in one embodiment of the present invention, the processing modules such as the text analysis section 3002, the rhyme control section 3006, and the synthesis unit selection section 3008 shown in FIG. 3 are files stored in the disk unit 1016 and therefore processes are all carried out by software, but an audio card may also be provided with a DSP by which these processes are carried out.

C. Dyadic Wavelet Conversion Processing

Figure 4:
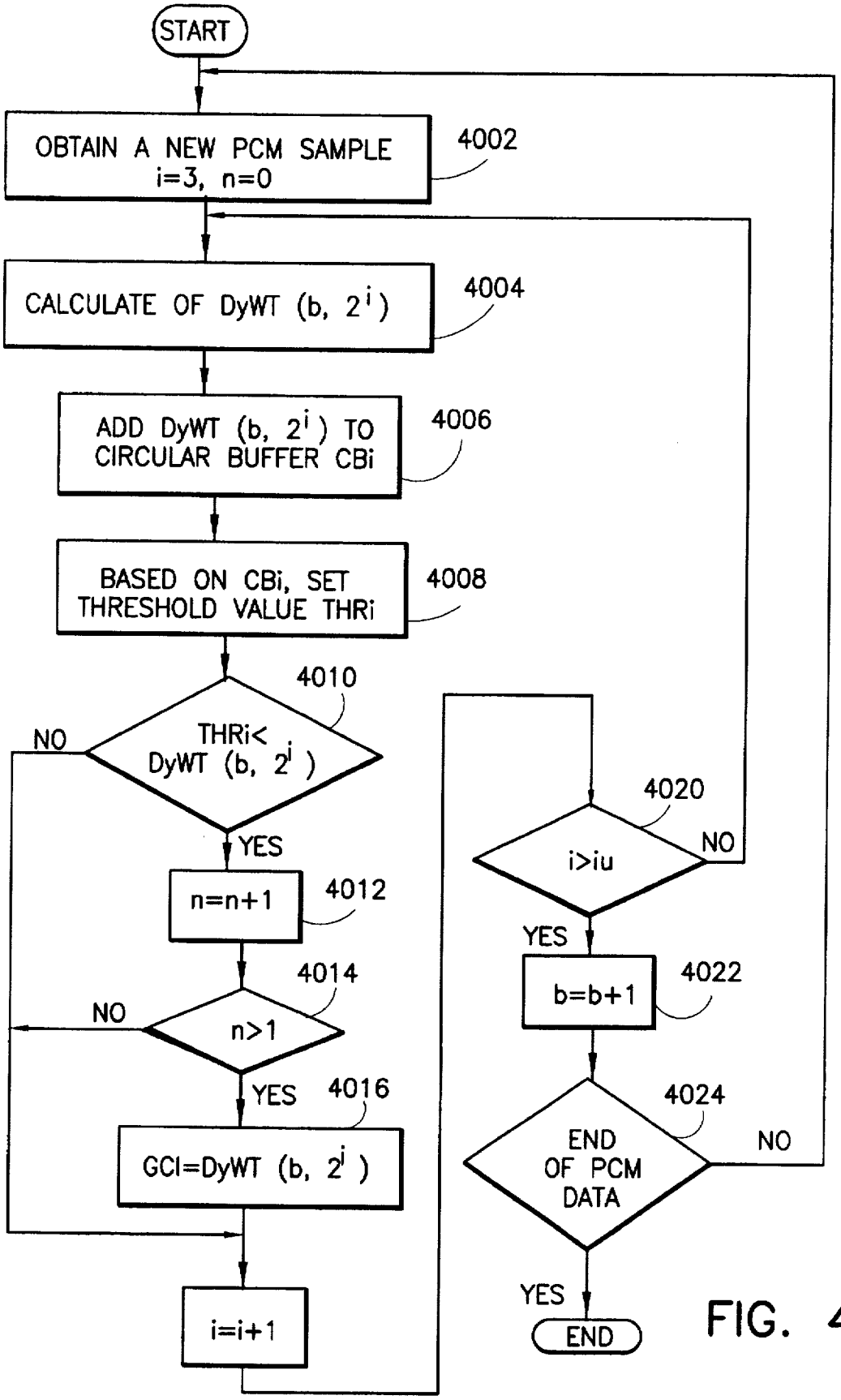
FIG. 4 is a detailed flowchart showing Wavelet conversion processing.

The process of dyadic-Wavelet-converting the PCM waveform of the speech signal input from the microphone according to the present invention and further estimating the glottal closure instants based on conversion will next be described in reference to the flowchart in FIG. 4. This process is mainly performed in the dyadic wavelet conversion section 2002 in FIG. 2.

First, in the first step, 4002, a new PCM sample is input. It is to be noted that, at this time, the speech input from the microphone has been converted to a series of PCM data and stored in the disk unit 1016. Therefore, in the processing in step 4002, the files of the PCM data stored in the disk unit 1016 are read in sequence.

In step 4002 value i representing a scale is also initialized to 3. This i is for providing a discrete dyadic sequence $2^i$ (i=3, 4. . . ). While in this embodiment the dyadic sequence $2^i$ is started from i=3, there are some cases where starting from i=1 is suitable, depending upon the sampling frequency. To make a long story short, whether the dyadic wavelet conversion is started from which scale depends upon the sampling frequency.

Further, in step 4002, n is initialized to 0 and represents the number of times estimated as a glottal closure instant on an individual scale.

In step 4004, dyadic Wavelet conversion DyWT(b, $2^i$) of the PCM speech signal x(t) is calculated based on the following equation, in which b represents a time index:

[Equation 1]

$$DyWT(b, 2^i) = \frac{1}{\sqrt{2^i}} \int_{-\infty}^{\infty} x(t)\Psi\left(\frac{t-b}{2^i}\right) dt$$

Particularly, the following is suitable as a function of $\Psi(\omega)$.

[Equation 2]

$$\Psi(\omega) = i\omega\left(\frac{\sin\left(\frac{\omega}{4}\right)}{\frac{\omega}{4}}\right)^{2m+2}$$

In one embodiment of the present invention, m=2 was adopted, but m may be selected to be more than 2. In addition, the concrete function form of $\Psi(\omega)$ is not limited to the form shown in Equation 2 but it has been found that, for $\omega$, the equation may be a first-order or second or higher order derivative of a function constituting a low-pass filter.

Next, in step 4006, the value of DyWT(b, $2^i$) calculated in this way is stored in a circular buffer CBi. This is for calculating the local threshold value according to the present invention. In this embodiment, one circular buffer Cbi comprises 315 buffer elements so as to cover 15 ms. Note that circular buffer Cbi is provided individually for each different scale i. The process of obtaining threshold value THRi (which is also provided individually for each different i) based on the values of DyWT(b, $2^i$) stored in sequence in circular buffers Cbi in connection with the value of b is as follows: For example, a logarithm of DyWT output at each scale is taken and the outputs for 15 to 20 ms are held in the circular buffers. An output histogram is then made at a unit of 1 Db from the outputs within the circular buffers, and a class value of high-order 80% of the accumulative frequency is obtained. This is returned from the logarithmic value to the linear value to obtain threshold value THRi.

Note that it is preferable that, for small scales, a percentage for obtaining a threshold value is made larger since DyWT contains a large number of unnecessary local peaks, and, for large scales, the percentage for obtaining a threshold value is made small to prevent a drop in the candidates of the glottal closure instants.

In step 4008, the local threshold value calculated in this way is set as THRi.

In step 4010, it is determined that DyWT(b, $2^i$) is greater than THRi. Such a determination is based on Kadambe's statement that a local peak position represents a glottal closure instant. A difference between the processing shown in this flowchart and Kadambe's technique is that, in Kadambe' technique, a local peak value within a frame is used as a large regional threshold value in the frame, but, in the processing shown in this flowchart, a statistical threshold value is used based on the accumulated value of the waveform of DyWT(b, $2^i$) in a certain range. Such a statistical threshold value is advantageous in that it can detect such glottal closure instants as would be missed in Kadambe's technique as well.

If the determination in step 4010 is affirmative, a value of n will be incremented by one in step 4012. This means that there has ben discovered the possibility that, at a certain scale i, b at a current point of time is a glottal closure instant. However, since there is also a possibility that a local peak other than a glottal closure instant is detected by mistake, it will not be determined at once according to the preferred embodiment of the present that a glottal closure instant was found, even if the determination in step 4010 were affirmative only at one scale i, and in step 4014 it is determined that n is greater than 1.

If it is determined in step 4014 that n is greater than 1, then b at the current point in time will be considered to be a glottal closure instant, since it has been determined that b is a local point in at least two scales i. In step 4016, local peak value DyWT(b, $2^i$) is output as glottal closure instant GCI.

It is to be noted that if, on the one hand, in the determination of step 4014, n is greater (e.g., n>2) so that processing will not advance to YES, the probability of a detected point being a glottal closure point becomes higher, but, on the other hand, there becomes higher a possibility that actual glottal closure instants will be missed. A threshold value for a suitable n is therefore selected in accordance with circumstances.

Next, in step 4018, i is incremented by one. This is for repeating the processing of steps 4004 to 4016 at one scale up i. It is to be noted that, if the processing in step 4010 or 4014 is negative, it will advance immediately to step 4018.

In step 4020, it is determined that i has exceeded predetermined threshold value iu. The value of iu is the maximum value of the scale of dyadic Wavelet conversion. If the value of iu becomes greater, the detection accuracy of glottal closure instant will be increased, but it will take correspondingly additional processing time. It is suitable as a rough criterion that the value of iu is about 5 when the value of i at the starting point is 3.

When a value of i does not exceed predetermined threshold value iu, step 4020 processing returns to step 4004.

When i exceeds the predetermined threshold value iu, b is incremented in step 4022 by one and it is determined in step 4024 whether the end of PCM data has been reached. If it is determined that PCM data has reached its end, processing will terminate. If not, step 4024 processing will return to step 4002. After the next PCM sample has been taken and n=0 and i=3 have been set, step 4002 processing advances to step 4004.

Figure 5:
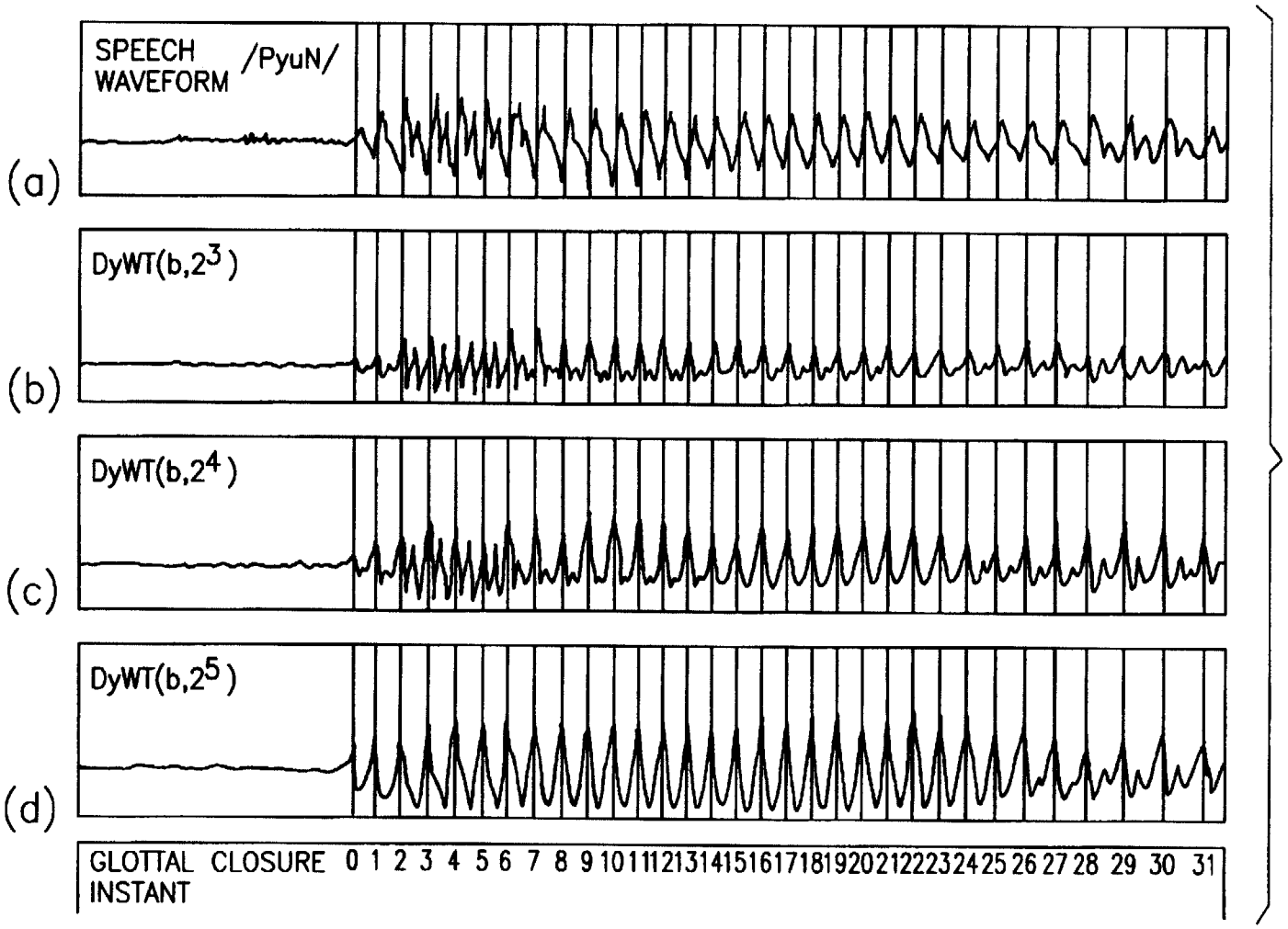
FIG. 5 is a diagram showing examples of a Wavelet-converted waveform.

FIG. 5 shows a PCM waveform (a) of a pronunciation such as "byu," a Wavelet-converted waveform (b) in the case of i=3, a Wavelet-converted waveform (c) in the case of i=4, and a Wavelet-converted waveform (d) in the case of i=5. In FIGS. 5(*b*), (*c*), and (d), the axis of abscissas represents a value of b. It follows from these figures that the Wavelet-converted waveforms are smoothed as the value of i is increased. Also, the axes of ordinates passing through the Wavelet-converted local peaks correspond to glottal closure instants.

D. Pitch Marking and Separation Processing

As a result of the above-described Wavelet conversion processing, one or more GCIs are obtained when GCI= DyWT(b, $2^i$). However, according to the above-described Wavelet conversion equation, the value of b obtained in this way is a value representing time, and it is therefore possible to determine a position to be pitch-marked at x(t), from the value of b obtained when GCI=DyWT(b, $2^i$). Thus, the PCM waveform x(t) is pitch-marked at the glottal closure instants, as shown in FIG. 5. At this time, the center of the waveform separation window is, for example, the local peak of waveform x(t) from the viewpoint of spectral distortion. In one embodiment, a Hamming window is used as a window function, and the window length is set to two times the synthesis pitch. Each of the units separated is stored in the synthesis unit dictionary 2010 shown in FIG. 2. Of course, the window function to be used in the waveform separation of the present invention is not limited to the Hamming window, and any arbitrary window function such as a rectangular or asymmetrical window function can be used.

E. Speech Synthesis Processing

Speech synthesis processing is performed by the speech synthesis section 3010 in FIG. 3. More particularly, according to the present invention, the speech synthesis section 3010 obtains the necessary speech synthesis unit waveforms from the synthesis unit dictionary 2010, and the desired synthesized speech is obtained as shown in FIG. 5 by shifting the unit waveforms along a synthesis pitch and overlapping them at the glottal closure instants as reference points.

That is, since the glottal closure instants can be extracted stably and accurately by making use of dyadic Wavelet conversion, speech in which pitch shaking is negligible and rumbling sounds are minimized can be synthesized stably.

Furthermore, flexible waveform separation becomes possible, compared to the conventional technique, by setting according to a modification of the present invention the reference point for overlapping and the waveform separation center at the time of synthesis to different positions.

ADVANTAGE OF THE INVENTION

As has been described above, according to the present invention, there is provided a pitch-synchronous waveform overlap method using glottal closure instants as reference points (pitch marks) for overlapping, and the advantage that speech in which pitch shaking is negligible and rumbling sounds are minimized can be synthesized is realized.

We claim:

1. A speech synthesis method comprising the steps of:

(a) detecting the glottal closure instants in digitized speech signals;

(b) pitch-marking said speech signal at said glottal closure instants;

(c) separating speech synthesis waveform units from said speech signals at the points different from said pitch-marked points;

(d) storing the separated speech synthesis waveform units; and (e) obtaining synthesized speech signals by shifting the stored speech synthesis waveform units along a synthesis pitch and overlapping them at the pitch-marked glottal closure instants as reference points.

2. The speech synthesis method as set forth in claim 1, wherein said points different from said pitch-marked points are the center of pitch waves.

3. The speech synthesis method as set forth in claim 1, wherein said step of detecting glottal closure instants includes the step of Wavelet-converting said digitized speech signals and detecting local peaks in the Wavelet-converted waveform.

4. The speech synthesis method as set forth in claim 3, wherein said step of detecting glottal closure instants includes the step of performing Wavelet conversion at a plurality of different scales and, in response to the determination that the same position of the local peak is detected in at least two scales, determining that the lock peak position is the glottal closure instant.

5. The speech synthesis method as set forth in claim 3, wherein the determination of the local peak position is performed by comparison with a statistical threshold value.

6. The speech synthesis method as set forth in claim 5, wherein said statistical threshold value is determined by a class value of a higher rank predetermined percent of the accumulated frequency of an output histogram obtained from the Wavelet-converted values.

7. A speech synthesis system comprising:

(a) means for detecting the glottal closure instants in digitized speech signals;

(b) means for pitch-marking said speech signal at said glottal closure instants;

(c) means for separating speech synthesis waveform units from said speech signals at the points different from said pitch-marked points;

(d) means for storing the separated speech synthesis waveform units; and (e) means for obtaining synthesized speech signals by shifting the stored speech synthesis waveform units along a synthesis pitch and overlapping them at the pitch-marked glottal closure instants as reference points.

8. The speech synthesis system as set forth in claim 7, wherein said points different from said pitch-marked points are the center of pitch waves.

9. The speech synthesis system as set forth in claim 7, wherein said means for detecting glottal closure instants includes means for Wavelet-converting said digitized speech signals and detecting local peaks of the Wavelet-converted waveform.

10. The speech synthesis system as set forth in claim 9, wherein said means for detecting said local peaks includes means for performing the Wavelet conversion at a plurality of different scales and, in response to the same position of the local peak detected at least two scales, determining that the lock peak positions is glottal closure instants.

11. The speech synthesis system as set forth in claim 9, wherein the determination of the local peak position is performed by comparison with a statistical threshold value.

12. The speech synthesis system as set forth in claim 11, which comprises means for determining said statistical threshold value, is determined by a class value of a higher rank predetermined percent of the accumulated frequency of an output histogram obtained from the Wavelet-converted values.

* * * * *